US010080087B2

(12) United States Patent
Guo et al.

(10) Patent No.: US 10,080,087 B2
(45) **Date of Patent: *Sep. 18, 2018**

(54) SPEAKER

(71) Applicant: AAC Technologies Pte. Ltd., Singapore (SG)

(72) Inventors: Shun Guo, Shenzhen (CN); Lubin Mao, Shenzhen (CN); Hongxing Wang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/417,144

(22) Filed: Jan. 26, 2017

(65) Prior Publication Data

US 2017/0347203 A1 Nov. 30, 2017

(30) Foreign Application Priority Data

May 26, 2016 (CN) ..... 2016 2 0489132

(51) Int. Cl.

| | |
|---|---|
| ***H04R 31/00*** | (2006.01) |
| ***H04R 9/06*** | (2006.01) |
| ***H04R 9/02*** | (2006.01) |
| ***H04R 9/04*** | (2006.01) |

(52) U.S. Cl.
CPC ..... *H04R 9/06* (2013.01); *H04R 9/025* (2013.01); *H04R 9/045* (2013.01); *H04R 2499/11* (2013.01)

(58) Field of Classification Search
CPC combination set(s) only.
See application file for complete search history.

(56) References Cited

U.S. PATENT DOCUMENTS

2014/0318885 A1* 10/2014 Kim ..... H04R 7/02 181/171

* cited by examiner

*Primary Examiner* — Amir Etesam
(74) *Attorney, Agent, or Firm* — Na Xu; IPro, PLLC

(57) ABSTRACT

The present disclosure provides is a speaker, including a frame, a vibrating system accommodated in the frame and a magnet portion driving the vibrating system, the vibrating system includes a diaphragm and a voice coil, the diaphragm includes a first fixing portion, a second fixing portion and a vibrating portion connected therebetween, the vibrating portion includes a vibrating main portion, a first suspension and a second suspension, the first fixing portion is fixed on the magnet portion, the second fixing portion is fixed on the frame, the vibrating main portion vibrates at a side of the magnet portion under driving of the voice coil. Comparing with the related art, vibration of the speaker diaphragm provided by the present disclosure is not limited by the magnet portion, thickness of the speaker can be made thin, which meets requirements of portable mobile electronic products on lighter and thinner components.

5 Claims, 6 Drawing Sheets

SPEAKER

TECHNICAL FIELD

The present disclosure relates to the field of electro-acoustic converting and, in particular, to a speaker for a portable mobile electronic product.

BACKGROUND

With the arrival of mobile Internet era, the number of smart devices is increasing gradually. Among numerous mobile devices, cellphone is the most common and portable mobile terminal device. At present, a cellphone already has diversified functions, an important function thereof is high quality music play, the speaker in the cellphone is one of the necessities for high quality music play.

Existing speaker generally includes a vibrating system composed of a diaphragm and a dome, and a magnet, the vibrating system covers the magnet, and vibrating space is reserved between the vibrating system and the magnet, the vibrating space is used to meet the amplitude requirements of the vibrating system.

However, being limited by the magnet, more space needs to be reserved above the magnet so as to meet the vibration of the diaphragm. As a result, the speaker cannot be made thin, which cannot meet the requirements of portable mobile electronic products on the components.

Therefore, there is a necessity to provide a new speaker, so as to solve the above problem.

BRIEF DESCRIPTION OF DRAWINGS

Many aspects of the exemplary embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The technical solutions of the present disclosure will be described clearly and completely combining the drawings in the embodiments of the present disclosure, obviously, the described embodiments are only part of the embodiments of the present disclosure, but not all of them. Other embodiments obtained by those skilled in the art without creative work are all belonging to the protection scope of the present disclosure.

Embodiment One

Figure 1:
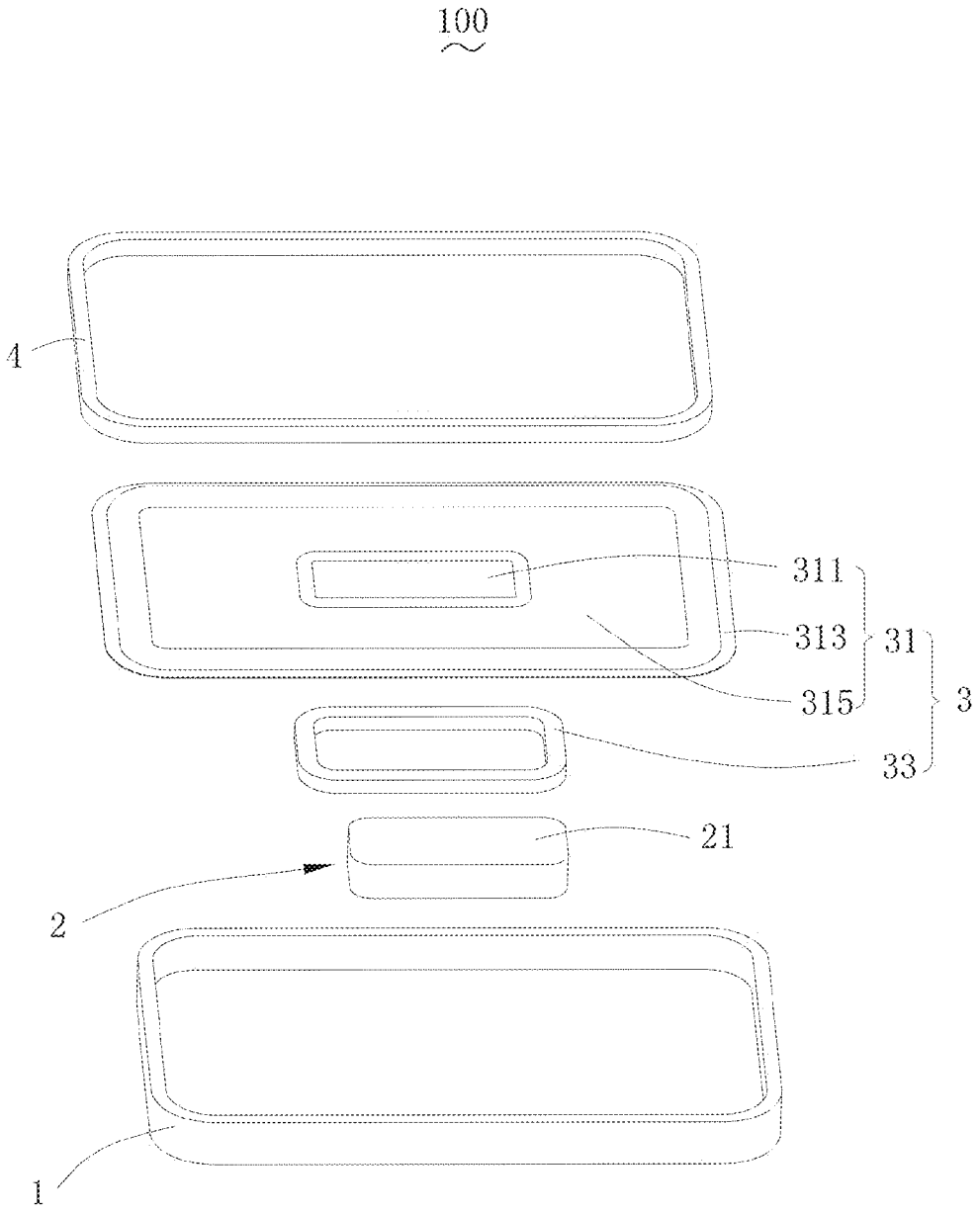
FIG. 1 is a perspective structural exploded view of a speaker in accordance with Embodiment One of the present disclosure.
Figure 2:
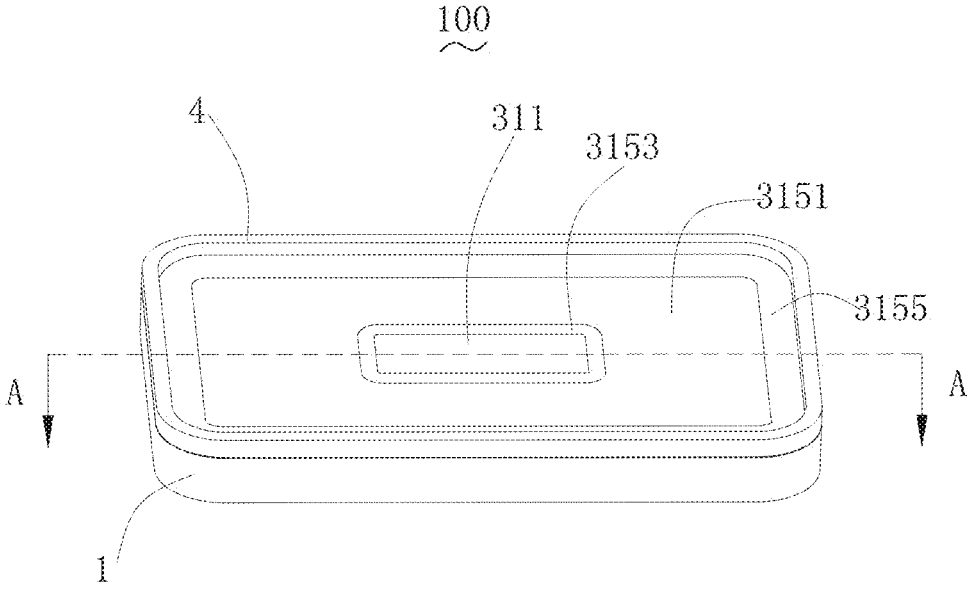
FIG. 2 is a perspective structural view of the speaker shown in FIG. 1.

As shown in FIG. 1 and FIG. 2, the present disclosure provides a speaker 100, including a frame 1, a magnet portion 2 accommodated in the frame 1, a vibrating system 3 held by the frame 1 and driven by the magnet portion 2, and a cover plate 4 which forms accommodating space together with the frame 1 so as to accommodate the magnet portion 2 and the vibrating system 3.

The frame 1 can be a plastic frame; the frame 1 can also be a yoke which, at this time, forms a magnetic circuit system together with the magnet portion 2.

Figure 3:
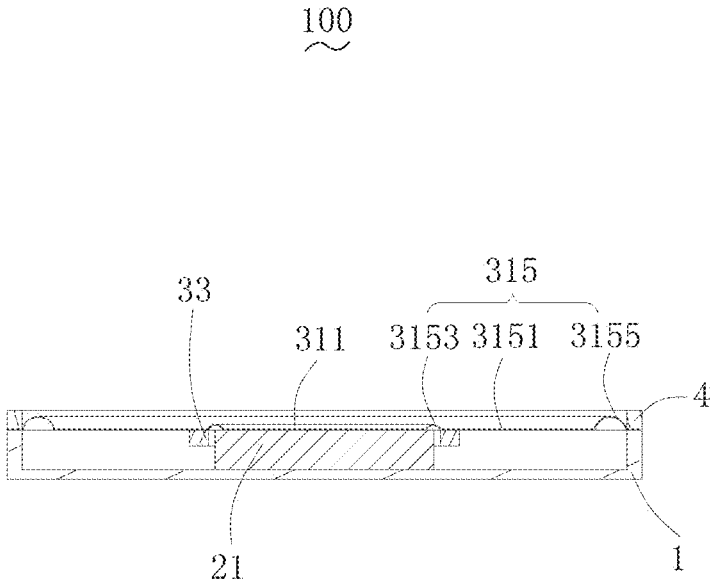
FIG. 3 is a sectional view of the speaker shown in FIG. 2 along A-A line.

Please refer to FIG. 3, the magnet portion 2 is a magnet 21 which generates magnetic field, the magnet 21 is parallel to the vibrating system 3.

Please refer to FIG. 1, FIG. 2 and FIG. 3, the vibration system 3 includes a diaphragm 31 and a voice coil 33 driving the diaphragm 31 to sound. The voice coil 33 is provided surrounding the outer periphery of the magnet 21, the diaphragm 31 is fitted on the surface of the frame 1.

The diaphragm 31 includes a first fixing portion 311 at a central position of the diaphragm, a second fixing portion 313 at an edge position of the diaphragm and a vibrating portion 315 connected between the first fixing portion 311 and the second fixing portion 313, the first fixing portion 311 is fixedly fitted on the surface of the second magnet 21, the second fixing portion 313 is fixedly fitted on the surface of the frame 1.

The vibrating portion 315 includes a vibrating main portion 3151, a first suspension 3153 extending from an inner periphery of the vibrating main portion 3151 and is connected with the first fixing portion 311, a second suspension 3155 extending from an outer periphery of the vibrating main portion 3151 and is connected with the second fixing portion 313, the first fixing portion 311 is fixed on the magnet 21, the second fixing portion 313 is fixed on the frame 1, the voice coil 33 is adhered underneath the vibrating main portion 3151, the vibrating main portion 3151 vibrates at a side of the magnet portion 2 under the driving of the voice coil 33. Therefore, the vibration of the diaphragm 31 will not be limited by the thickness of the magnet 21; the first suspension 3153 can isolate the air flow between the front vocal cavity and rear vocal cavity of the speaker 100, and reduce the polarization generated during vibration of the diaphragm. The voice coil 33 is provided underneath the vibrating main portion 3151 and at the outer periphery of the first suspension 3153, in a vibration direction of the vibrating system 3, the projection of the voice coil 33 does not overlap with the projection of the first suspension 3153.

Embodiment Two

Figure 4:
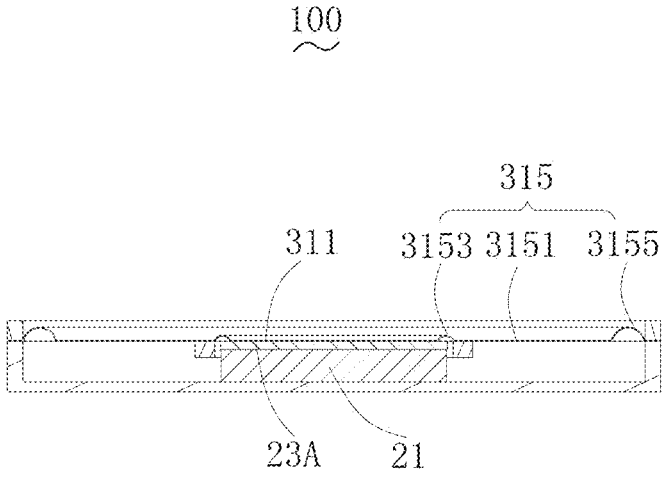
FIG. 4 is a structural schematic view of a speaker in accordance with Embodiment Two of the present disclosure.

Please refer to FIG. 4, as an improvement of the speaker 100, the magnet portion 2 further includes a pole plate 23A, the pole plate 23A is attached onto the surface of the magnet 21, the first fixing portion 311 is attached onto the surface of the pole plate 23A.

Embodiment Three

Figure 5:
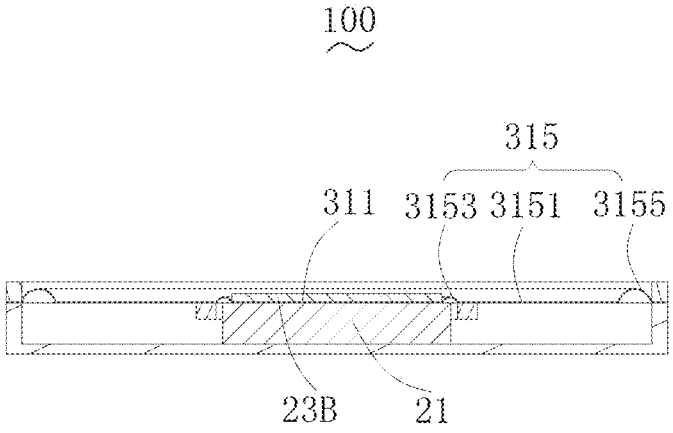
FIG. 5 is a structural schematic view of a speaker in accordance with Embodiment Three of the present disclosure.

Please refer to FIG. 5, as an improvement of the speaker 100, the pole plate 23B is fixed on a side of the first fixing portion 311 opposite to the position where the magnet 21 is located, the first fixing portion 311 is clamped between the magnet 21 and the pole plate 23B.

Embodiment Four

Figure 6:
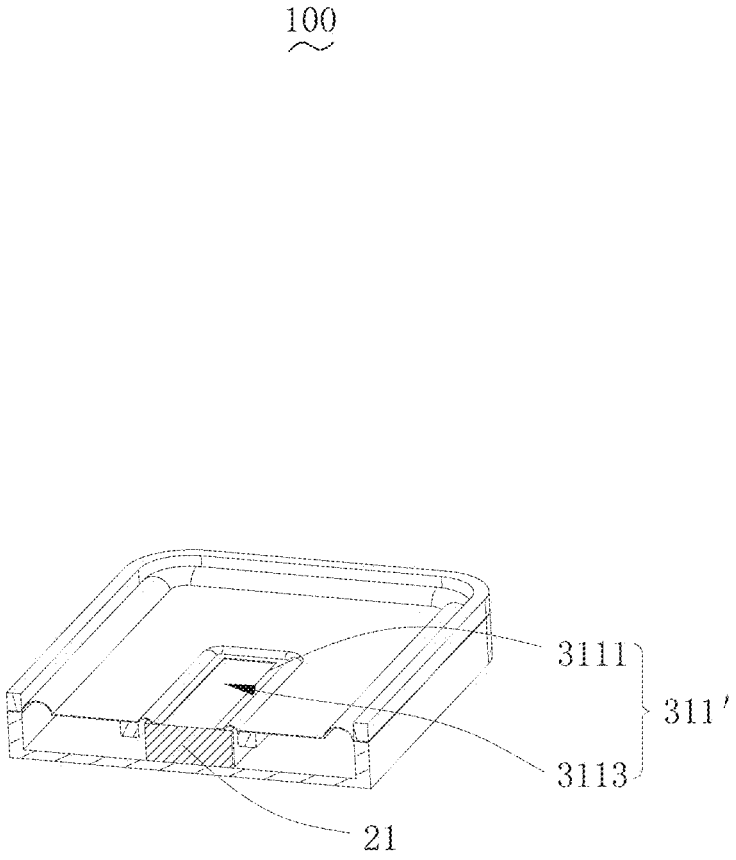
FIG. 6 is a structural schematic view of a speaker in accordance with Embodiment Four of the present disclosure.

Please refer to FIG. 6, as an improvement of the speaker 100, the first fixing portion 311' of the diaphragm 31 includes an edge fixing portion 3111 and a through hole 3113, the edge fixing portion 3111 is provided surrounding the through hole 3113, the edge fixing portion 3111 is fixed on the magnet 21. Providing a through hole 3113 on the diaphragm 31 can, in an aspect, save material and, in another aspect, receive the glue used when adhering the pole plate 23.

Comparing with the related art, in the speaker 100 provided by the present disclosure, since the vibrating main portion 3151 is vibrating at the side of the magnet portion 2, the diaphragm 31 can vibrate without being limited by the thickness of the magnet portion 2, the component can be made thin, which effectively meets the requirements of portable electronic products on a lighter and thinner structure of the speaker 100.

The above merely shows embodiments of the present disclosure, it should be noted that, improvements can be made by those skilled in the art without departing from the inventive concept of the present disclosure, however, these shall belong to the protection scope of the present disclosure.

What is claimed is:

1. A speaker, comprising:

a frame;

a vibrating system held by the frame, the vibrating system comprises a diaphragm and a voice coil; and a magnet portion accommodated in the frame and driving the vibrating system;

wherein the diaphragm comprises a first fixing portion at a central position of the diaphragm, a second fixing portion at an edge position of the diaphragm and a vibrating portion connected between the first fixing portion and the second fixing portion, the vibrating portion comprises a vibrating main portion, a first suspension extending from an inner periphery of the vibrating main portion and is connected with the first fixing portion, a second suspension extending from an outer periphery of the vibrating main portion and is connected with the second fixing portion, the first fixing portion is fixed on the magnet portion, the second fixing portion is fixed on the frame, the vibrating main portion vibrates at a side of the magnet portion under driving of the voice coil.

2. The speaker as described in claim 1, wherein the magnet portion is a magnet, the first fixing portion is attached onto a surface of the magnet.

3. The speaker as described in claim 1, wherein the magnet portion comprises a magnet and a pole plate attached onto a surface of the magnet, the first fixing portion is attached onto a surface of the pole plate.

4. The speaker as described in claim 1, wherein the magnet portion comprises a magnet and a pole plate, the first fixing portion is clamped between the magnet and the pole plate.

5. The speaker as described in claim 1, wherein the diaphragm is provided with a through hole formed through surrounding by the first fixing portion.

* * * * *